US009782017B1

(12) United States Patent
Luberto et al.

(10) Patent No.: US 9,782,017 B1
(45) Date of Patent: Oct. 10, 2017

(54) DISPLAY AND DISPENSING APPARATUS AND METHOD

(71) Applicant: Henschel-Steinau, Inc., Allendale, NJ (US)

(72) Inventors: Michael D. Luberto, River Vale, NJ (US); Michael D. DeSena, West Caldwell, NJ (US); Getachew Kassa, West Orange, NJ (US); Gary Forman, New City, NY (US)

(73) Assignee: Henschel-Steinau, Inc., Allendale, NJ (US)

( * ) Notice: Subject to any disclaimer, the term of this patent is extended or adjusted under 35 U.S.C. 154(b) by 0 days.

(21) Appl. No.: 15/456,896

(22) Filed: Mar. 13, 2017

(51) Int. Cl.
*A47F 1/12* (2006.01)
*A47F 5/00* (2006.01)

(52) U.S. Cl.
CPC ..... *A47F 1/125* (2013.01); *A47F 5/005* (2013.01)

(58) Field of Classification Search
CPC .. A47F 1/125; A47F 1/126; A47F 1/04; A47F 1/12; A47F 1/00; A47F 5/005; A47F 5/0025; A47F 5/0068; A47F 5/0093; A47F 7/0007; A47F 7/28; A47F 7/281; A47B 57/585; A47B 57/586; A47B 57/58; A47B 57/583; A47B 57/581; A47B 57/588; A47B 65/15; A47B 73/006; A47B 73/00
USPC ..... 211/59.2, 59.3
See application file for complete search history.

(56) References Cited

U.S. PATENT DOCUMENTS

| | | | | |
|---|---|---|---|---|
| 1,524,748 | A | 2/1925 | O'Connor | |
| 1,675,269 | A | 6/1928 | Hine | |
| 3,308,964 | A | 3/1967 | Pistone | |
| 3,703,964 | A * | 11/1972 | Field | A47F 5/005 211/184 |
| 4,394,910 | A | 7/1983 | Miller | |
| 4,615,276 | A | 10/1986 | Garabedian | |
| 5,190,186 | A | 3/1993 | Yablans et al. | |
| 5,325,792 | A | 7/1994 | Mulloy | |
| 5,390,802 | A * | 2/1995 | Pappagallo | A47B 45/00 211/187 |
| 5,469,976 | A | 11/1995 | Burchell | |
| 5,657,702 | A | 8/1997 | Ribeyrolles | |
| 5,673,801 | A | 10/1997 | Markson | |
| 6,234,328 | B1 | 5/2001 | Mason | |
| 6,533,131 | B2 | 3/2003 | Bada | |
| 7,641,057 | B2 | 1/2010 | Mueller et al. | |
| 7,823,734 | B2 | 11/2010 | Hardy | |
| 8,113,360 | B2 * | 2/2012 | Olson | A47F 5/005 211/59.3 |
| 8,127,944 | B2 | 3/2012 | Hardy | |
| 8,312,999 | B2 | 11/2012 | Hardy | |
| 8,453,850 | B2 | 6/2013 | Hardy | |

(Continued)

*Primary Examiner* — Patrick Hawn
(74) *Attorney, Agent, or Firm* — Arthur Jacob

(57) ABSTRACT

An apparatus and method for displaying and dispensing merchandise at a point-of-purchase adjacent a display shelf secures at least one divider to a retainer plate affixed to the display shelf. An elongate lock bar extends beneath the divider, along a predominant portion of the length of the divider, and is coupled with the divider for unbiased sliding movement to selectively engage or disengage teeth carried by the lock bar and complementary teeth placed on the retainer plate to secure the divider in a selected location along the retainer plate or release the divider for movement to another selected location.

28 Claims, 3 Drawing Sheets

(56) References Cited

U.S. PATENT DOCUMENTS

| | | | | |
|---|---|---|---|---|
| 8,579,123 | B2 | 11/2013 | Mueller et al. | |
| 8,739,984 | B2 | 6/2014 | Hardy | |
| 8,746,468 | B2 | 6/2014 | Poulokefalos | |
| 8,851,303 | B2 * | 10/2014 | Crawbuck | A47F 1/12 211/59.2 |
| 8,863,963 | B2 | 10/2014 | Hardy | |
| 8,967,394 | B2 | 3/2015 | Hardy et al. | |
| 8,978,903 | B2 | 3/2015 | Hardy | |
| 8,978,904 | B2 | 3/2015 | Hardy | |
| 9,138,075 | B2 | 9/2015 | Hardy et al. | |
| 9,173,504 | B2 | 11/2015 | Hardy | |
| 9,173,505 | B2 | 11/2015 | Hardy | |
| 9,185,999 | B2 | 11/2015 | Hardy | |
| 9,232,864 | B2 | 1/2016 | Hardy et al. | |
| 9,237,816 | B2 | 1/2016 | Hardy | |
| 9,259,102 | B2 | 2/2016 | Hardy et al. | |
| 9,265,358 | B2 | 2/2016 | Hardy | |
| 9,265,362 | B2 | 2/2016 | Hardy | |
| 9,289,078 | B2 | 3/2016 | Hardy | |
| 9,392,887 | B2 | 7/2016 | Nilsson | |
| 9,402,485 | B2 | 8/2016 | Hardy et al. | |
| 9,445,675 | B1 * | 9/2016 | DeSena | A47F 1/126 |
| 9,468,309 | B2 | 10/2016 | Grubbs et al. | |
| 9,498,057 | B2 | 11/2016 | Hardy | |
| 2002/0170866 | A1 | 11/2002 | Johnson et al. | |
| 2004/0245197 | A1 * | 12/2004 | McElvaney | A47F 1/125 211/184 |
| 2005/0077260 | A1 | 4/2005 | Mueller et al. | |
| 2005/0139560 | A1 | 6/2005 | Whiteside et al. | |
| 2011/0042332 | A1 | 2/2011 | Hardy | |
| 2013/0026117 | A1 | 1/2013 | Hardy | |
| 2013/0206713 | A1 | 8/2013 | Hardy | |
| 2014/0175034 | A1 | 6/2014 | Hardy | |
| 2014/0263134 | A1 | 9/2014 | Walker et al. | |
| 2015/0108075 | A1 | 4/2015 | Hardy et al. | |
| 2016/0029788 | A1 | 2/2016 | Hardy | |
| 2016/0296038 | A1 | 10/2016 | Walker et al. | |
| 2016/0296039 | A1 | 10/2016 | Bird et al. | |

* cited by examiner

DISPLAY AND DISPENSING APPARATUS AND METHOD

The present invention relates generally to the point-of-purchase display and dispensing of merchandise and pertains, more specifically, to apparatus and method for enabling the display and ready dispensing of serially arranged merchandise packages at a point-of-purchase dispensing location, while facilitating the accommodation of merchandise packages of different dimensions placed at a readily selected location.

An ever-increasing variety of packaged merchandise offered for sale at points-of-purchase located along store shelves has led to a requirement for better organization of such merchandise, along with increased ease of selection and dispensing, together with a simplified accommodation of items of different dimensions placed at various selected locations. Display and dispensing trays have become staples in assisting the organization, display and dispensing of such items.

The present invention provides an apparatus and method for displaying and dispensing merchandise at a point-of-purchase and for facilitating the accommodation of such items at the point-of-purchase. As such the present invention attains several objects and advantages, some of which are summarized as follows: Provides apparatus and method that facilitate the display and dispensing of serially arranged merchandise packages at a point-of-purchase, together with ease of selective adjustment, and securement of such adjustment, to accommodate merchandise packages of different dimensions; enables increased versatility in arranging for the dispensing of merchandise at a point-of-purchase while allowing simplified adjustments at the point-of-purchase to accommodate merchandise being dispensed; facilitates the organization of merchandise for display and dispensing at a selected location along store shelves; allows ease of set up and use for accommodating a wide variety of merchandise displayed and dispensed at a point-of-purchase; offers less obtrusive and aesthetically more desirable apparatus for the display and dispensing of merchandise packages; provides a less complex apparatus and method for establishing the display and dispensing of merchandise at a point-of-purchase; provides apparatus for the display and dispensing of merchandise packages capable of exemplary performance over a relatively long service life.

The above objects and advantages, as well as further objects and advantages, are attained by the present invention which may be described briefly as an apparatus for displaying and dispensing merchandise at a point-of-purchase adjacent a display shelf extending in lateral directions, the merchandise being in the form of packages arranged serially along a path of travel extending in longitudinal directions toward a forward dispensing location placed at the point-of-purchase, the apparatus comprising: at least one divider for extending along the longitudinal direction, adjacent the path of travel in juxtaposition with the serially arranged packages, the divider having a basal platform and a length extending between a near end for placement adjacent the forward dispensing location, and a far end spaced longitudinally away from the near end; a securing arrangement for securing at least the near end of the divider at a selected lateral location along the display shelf, with the divider extending along the longitudinal direction and the near end affixed against inadvertent movement in a lateral direction, as well as against inadvertent movement in a longitudinal direction, the securing arrangement including a retainer plate for affixation to the display shelf with the retainer plate extending along the lateral directions adjacent the point-of-purchase; a first locking feature extending in lateral directions along the retainer plate; an elongate lock bar having a longitudinal length extending in longitudinal directions beneath the basal platform of the divider, along a predominant portion of the length of the divider, the lock bar being coupled with the divider for unbiased sliding movement along the divider in longitudinal directions including a forward direction toward the dispensing location, to a forward position, and a rearward direction away from the dispensing location, to a rearward position, with the lock bar extending along the predominant portion of the length of the divider, adjacent a predominant portion of the path of travel, to resist lateral movement of divider relative to the lock bar; and a second locking feature carried by the lock bar in position to engage the first locking feature in a locking engagement upon movement of the lock bar into one of the forward position and the rearward position, thereby precluding movement of the divider in lateral directions, and in position to disengage the second locking feature from the first locking feature upon movement of the lock bar into the other of the forward position and the rearward position, thereby permitting selective movement of the divider in lateral directions.

In addition, the present invention includes a method for displaying and dispensing merchandise at a point-of-purchase adjacent a display shelf extending in lateral directions, the merchandise being in the form of packages arranged serially along a path of travel extending in longitudinal directions toward a forward dispensing location placed at the point-of-purchase, the method comprising: extending at least one divider along the longitudinal direction, adjacent the path of travel in juxtaposition with the serially arranged packages, the divider having a basal platform and a length extending between a near end for placement adjacent the forward dispensing location, and a far end spaced longitudinally away from the near end; securing at least the near end of the divider at a selected lateral location along the display shelf, with the divider extending along the longitudinal direction and the near end affixed against inadvertent movement in a lateral direction, as well as against inadvertent movement in a longitudinal direction, the step of securing including affixing a retainer plate to the display shelf with the retainer plate extending along the lateral directions adjacent the point-of-purchase; extending a first locking feature in lateral directions along the retainer plate; coupling an elongate lock bar with the divider for unbiased sliding movement along the divider in longitudinal directions including a forward direction toward the dispensing location, to a forward position, and a rearward direction away from the dispensing location, to a rearward position, the lock bar having a longitudinal length extending in longitudinal directions beneath the basal platform of the divider, along a predominant portion of the length of the divider, with the lock bar extending along the predominant portion of the length of the divider, adjacent a predominant portion of the path of travel, to resist lateral movement of divider relative to the lock bar; and placing a second locking feature on the lock bar in position to engage the first locking feature in a locking engagement upon movement of the lock bar into one of the forward position and the rearward position, thereby precluding movement of the divider in lateral directions, and in position to disengage the second locking feature from the first locking feature upon movement of the lock bar into the other of the forward position and the rearward position, thereby permitting selective movement of the divider in lateral directions.

The invention will be understood more fully, while still further objects and advantages will become apparent, in the following detailed description of preferred embodiments of the invention illustrated in the accompanying drawing, in which.

Figure 1:
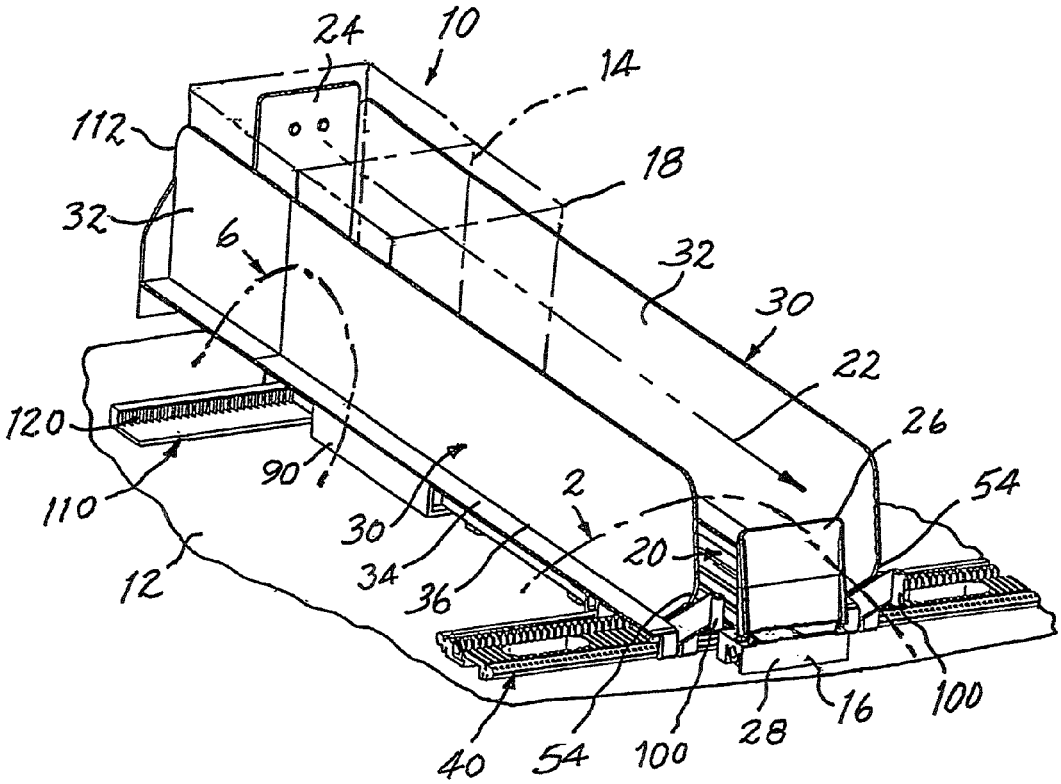
FIG. 1 is a pictorial view showing an apparatus constructed in accordance with the present invention for operation in accordance with the method of the present invention.
Figure 2:
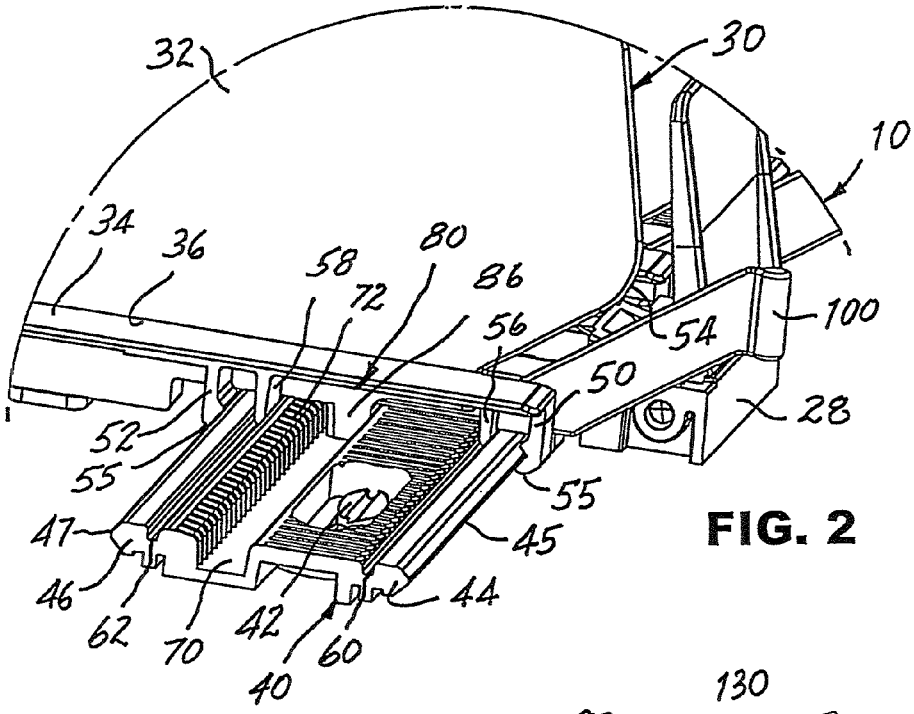
FIG. 2 is an enlarged, fragmentary view of a portion of FIG. 1, indicated by arrow 2 in FIG. 1.

Referring now to the drawing, and especially to FIGS. 1 and 2 thereof, an apparatus constructed in accordance with the present invention, for operation in accordance with the method of the present invention, as illustrated at 10 and is shown installed upon a shelf 12 for presenting merchandise packages, shown in FIG. 1 in phantom at 14, for display and dispensing at a point-of-purchase 16. Apparatus 10 includes a pusher track assembly 20 upon which merchandise packages 14 are arranged serially, in a column 18, along a path of travel 22 extending longitudinally between a pusher 24 and a gate 26 placed at a forward dispensing location 28 at the point-of-purchase 16, all as is now conventional. A pair of dividers 30 include divider walls 32 between which divider walls 32 merchandise packages 14 are confined against lateral movement, while supported upon basal platforms 34 extending along respective lower edges 36 of dividers 30 for providing an organized display along the shelf 12, while assisting in maintaining alignment of the serial merchandise packages 14 within column 18 along the path of travel 22 for smooth and uninterrupted dispensing at point-of-purchase 16.

A retainer plate 40 is affixed to shelf 12, as by threaded fasteners 42, and, as best seen in FIG. 2, retainer plate 40 provides a forward lip 44, extending in lateral directions along a forward edge 45 of retainer plate 40, and a rearward lip 46 extending in lateral directions along a rearward edge 47 of retainer plate 40, with the retainer plate 40 extending along the shelf 12 in lateral directions transverse to the longitudinal direction of path of travel 22. Forward and rearward fingers 50 and 52 are carried by each divider 30, adjacent the near end 54 of the divider 30, and are engaged with respective lips 44 and 46 to hold the dividers 30 in juxtaposition with shelf 12, the fingers 50 and 52 each having a hook-like configuration that engages a corresponding lip 44 and 46 at each tip 55 to preclude lifting of a divider 30 from the retainer plate 40. Edges 45 and 47 are uninterrupted along lateral directions, presenting each lip 44 and 46 with a continuous surface configuration that promotes smooth and even selected translation of each divider 30 along lateral directions. At the same time, further fingers 56 and 58 are integral with and depend from each divider 30 to enter a respective corresponding groove 60 and 62, which grooves 60 and 62 extend laterally along retainer plate 40, to stabilize each divider 30, secured against inadvertent movement in longitudinal directions, at a selected lateral location along the retainer plate 40. In this manner, each divider 30 is engaged with retainer plate 40 for smooth and stable translation in lateral directions along retainer plate 40, with each divider 30 secured against inadvertent movement in longitudinal and latitudinal directions, while remaining oriented in the longitudinal direction, essentially perpendicular to the lateral directions in which retainer plate 40 extends.

Turning now to FIGS. 3 through 6, as well as to FIGS. 1 and 2, upon reaching a desired lateral position along retainer plate 40, each divider 30 is secured in place against inadvertent movement in a lateral direction by a locking mechanism selectively operated by manually engaging locking features placed on the retainer plate 40 and carried by the dividers 30. To that end, retainer plate 40 includes a channel 70 extending in lateral directions along retainer plate 40, adjacent the rearward edge 47, and a first locking feature extends in lateral directions along the retainer plate 40, the first locking feature being shown in the form of a series of teeth 72 located within channel 70, adjacent rearward edge 47, and projecting in a forward direction.

An elongate lock bar 80 has a longitudinal length between a forward end 82 and a rearward end 84 and extends in longitudinal directions along lower edge 36, beneath the basal platform 34 of each divider 30, each lock bar 80 extending along a predominant portion P of the length of the divider 30. Lock bar 80 is coupled with divider 30 for sliding movement along the divider 30 in longitudinal directions including a forward direction toward the dispensing location 28, to a forward position illustrated at F in FIG. 5, and a rearward direction away from the dispensing location 28, to a rearward position, illustrated at R in FIG. 5. Lock bar 80 carries a second locking feature intermediate forward and rearward ends 82 and 84, the second locking feature being shown in the form of teeth 86 having a configuration complementary to teeth 72. Thus, with lock bar 80 in the forward position, shown in FIG. 2 and illustrated at F in FIG. 5, teeth 86 are retracted from teeth 72 and corresponding divider 30 is free to move in lateral directions to a selected location along retainer plate 40. Upon divider 30 reaching the selected location along retainer plate 40, lock bar 80 is moved manually in a rearward direction to the rearward position depicted at R in FIG. 5, thereby engaging teeth 86 with teeth 72, as illustrated at 88 in FIG. 5, to secure divider 30 in place at the selected location. Brackets 90 are integral with divider 30 beneath the basal platform 34, and extend longitudinally along the lower edge 36 of divider 30 over a length sufficient to maintain the elongate lock bar 80 coupled in place along the divider 30 such that by virtue of the extended length of lock bar 80, divider 30 is firmly secured against inadvertent lateral movements.

Upon manual movement of lock bar 80 to the forward position, depicted at F, the extended length of lock bar 80 facilitates lateral movement of an entire column 18 of merchandise packages 14 held between adjacent, now movable dividers 30 by virtue of the reinforcement of each divider 30 provided by the extended length of lock bar 80 along predominant portion P of the length of each divider 30. In the preferred construction, the predominant portion P of the length of a divider 30 is at least about fifty percent of the length of the divider 30. Manual movement of lock bar 80 is unbiased, that is, lock bar 80 is free to slide between the forward and rearward positions described above. A handle 100 extends forward from the forward end 82 of lock bar 80 and is placed adjacent the dispensing location 28 for grasping to facilitate selective manual sliding of the lock bar 80 between the forward position shown at F and the rearward position shown at R. Thus, handle 100 is located for convenient operation, pulled forward for selective movement of divider 30 in lateral directions and pushed rearward for securing divider 30 in place, with handle 100 retracted so as to be unobtrusive when divider 30 is secured at a selected location.

Figure 3:
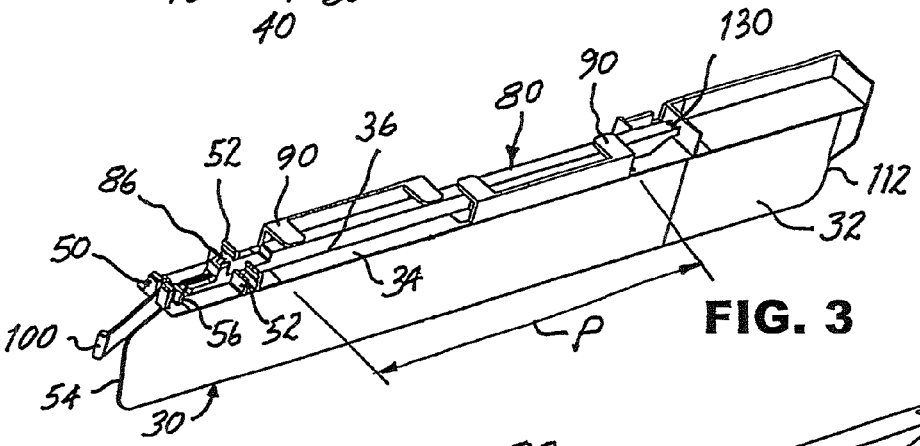
FIG. 3 is a pictorial view of a divider assembly of the apparatus.
Figure 4:
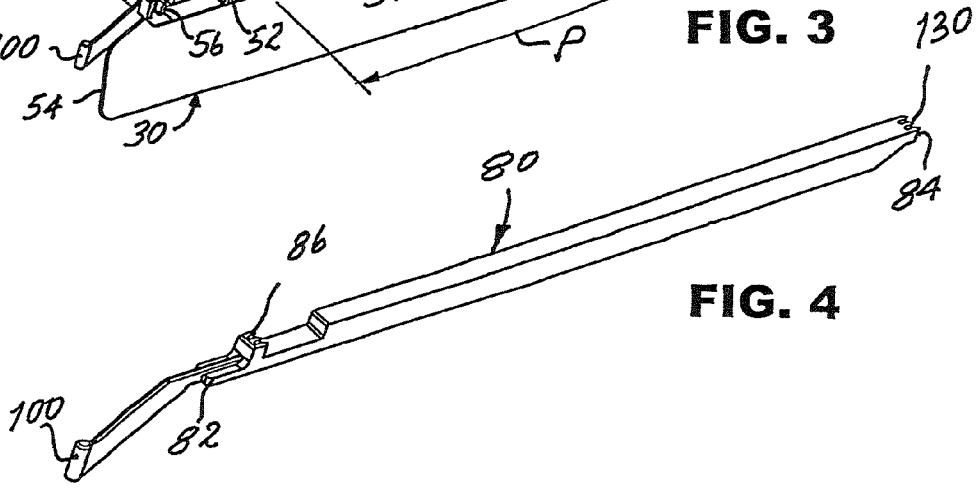
FIG. 4 is a pictorial view of a lock bar of the apparatus.
Figure 5:
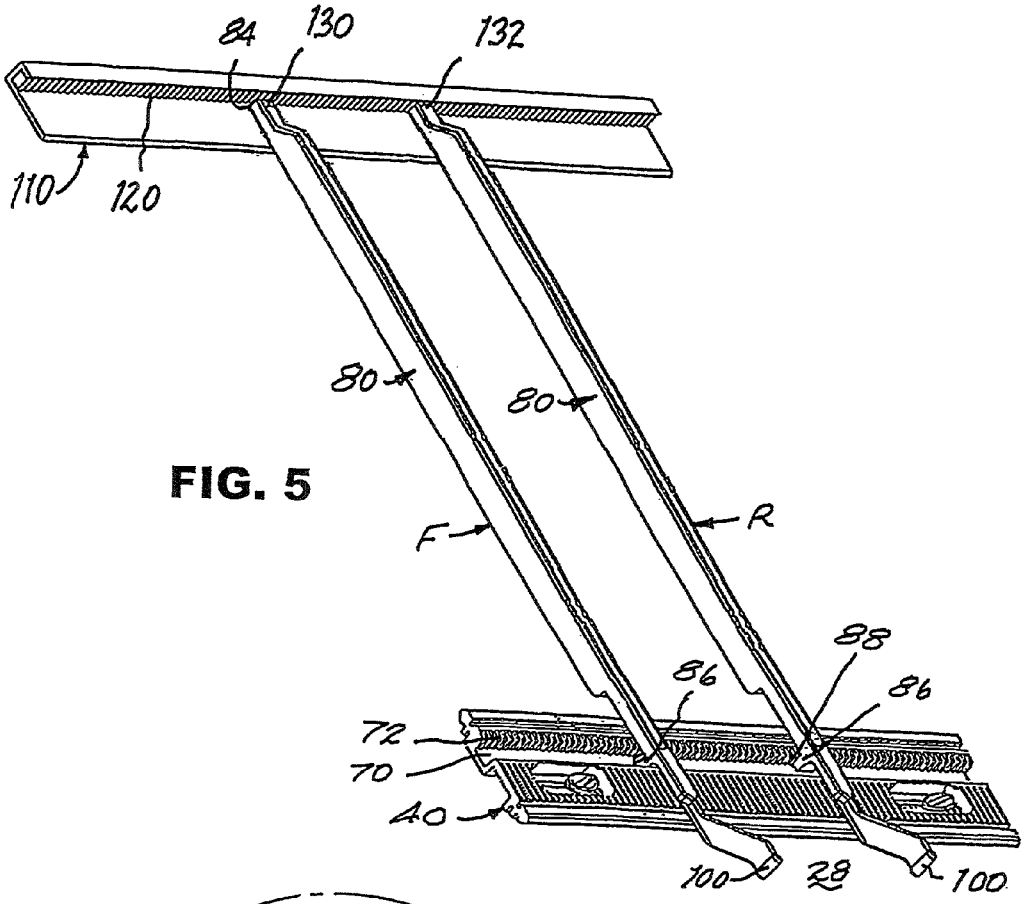
FIG. 5 is a somewhat diagrammatic pictorial view showing the operation of component parts in accordance with the present invention.
Figure 6:
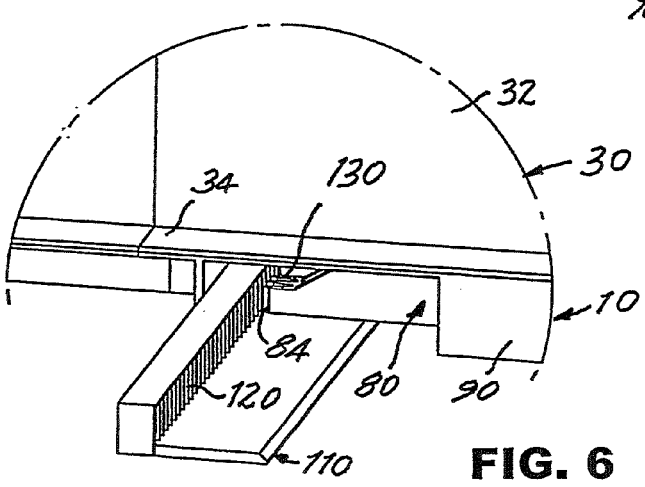
FIG. 6 is an enlarged, fragmentary view of a further portion of FIG. 1, indicated by arrow 6 in FIG. 1.

Referring now to FIGS. 1, 5 and 6, as well as to FIGS. 3 and 4, in installations where shelf 12 has a greater longitudinal depth, a second retainer plate 110 may be placed longitudinally along shelf 12, adjacent the far end 112 of each divider 30. Second retainer plate 110 carries a further locking feature shown in the form of a series of teeth 120 and lock bar 80 is provided with a still further locking feature shown in the form of teeth 130 placed at rearward end 84. Upon placement of a divider 30 at a selected lateral location, manual sliding movement of lock bar 80 longitudinally rearwardly will engage teeth 130 with teeth 120, as seen at 132 in FIG. 5, simultaneous with the engagement of teeth 86 with teeth 72, to further secure divider 30 at the selected lateral location. Second retainer plate 110 may be affixed to shelf 12 as, for example, by an adhesive; however, in an alternate arrangement, second retainer plate 110 is merely placed along shelf 12, without being affixed to shelf 12, thus enabling limited movement of second retainer plate 110 relative to shelf 12 for increased accuracy in alignment of a divider 30 with the longitudinal directions.

It will be seen that the present invention attains all of the objects and advantages summarized above, namely: Provides apparatus and method that facilitate the display and dispensing of serially arranged merchandise packages at a point-of-purchase, together with ease of selective adjustment, and securement of such adjustment, to accommodate merchandise packages of different dimensions; enables increased versatility in arranging for the dispensing of merchandise at a point-of-purchase while allowing simplified adjustments at the point-of-purchase to accommodate merchandise being dispensed; facilitates the organization of merchandise for display and dispensing at a selected location along store shelves; allows ease of set up and use for accommodating a wide variety of merchandise displayed and dispensed at a point-of-purchase; offers less obtrusive and aesthetically more desirable apparatus for the display and dispensing of merchandise packages; provides a less complex apparatus and method for establishing the display and dispensing of merchandise at a point-of-purchase; provides apparatus for the display and dispensing of merchandise packages capable of exemplary performance over a relatively long service life.

It is to be understood that the above detailed description of preferred embodiments of the invention is provided by way of example only. Various details of design, construction and procedure may be modified without departing from the true spirit and scope of the invention as set forth in the appended claims.

The embodiments of the invention in which an exclusive property or privilege is claimed are defined as follows:

1. An apparatus for displaying and dispensing merchandise at a point-of-purchase adjacent a display shelf extending in lateral directions, the merchandise being in the form of packages arranged serially along a path of travel extending in longitudinal directions toward a forward dispensing location placed at the point-of-purchase, the apparatus comprising:

at least one divider for extending along the longitudinal direction, adjacent the path of travel in juxtaposition with the serially arranged packages, the divider having a basal platform and a length extending between a near end for placement adjacent the forward dispensing location, and a far end spaced longitudinally away from the near end;

a securing arrangement for securing at least the near end of the divider at a selected lateral location along the display shelf, with the divider extending along the longitudinal direction and the near end affixed against inadvertent movement in a lateral direction, as well as against inadvertent movement in a longitudinal direction, the securing arrangement including a retainer plate for affixation to the display shelf with the retainer plate extending along the lateral directions adjacent the point-of-purchase;

a first locking feature extending in lateral directions along the retainer plate;

an elongate lock bar having a longitudinal length extending in longitudinal directions beneath the basal platform of the divider, along a predominant portion of the length of the divider, the lock bar being coupled with the divider for unbiased sliding movement along the divider in longitudinal directions including a forward direction toward the dispensing location, to a forward position, and a rearward direction away from the dispensing location, to a rearward position, with the lock bar extending along the predominant portion of the length of the divider, adjacent a predominant portion of the path of travel, to resist lateral movement of divider relative to the lock bar; and a second locking feature carried by the lock bar in position to engage the first locking feature in a locking engagement upon movement of the lock bar into one of the forward position and the rearward position, thereby precluding movement of the divider in lateral directions, and in position to disengage the second locking feature from the first locking feature upon movement of the lock bar into the other of the forward position and the rearward position, thereby permitting selective movement of the divider in lateral directions.

2. The apparatus of claim 1 wherein the predominant portion of the length of the divider is at least about fifty percent of the length of the divider.

3. The apparatus of claim 1 wherein:

the retainer plate includes a laterally extending longitudinally forward edge and a laterally extending longitudinally rearward edge;

the first locking feature is juxtaposed with the rearward edge; and the second locking feature is placed on the lock bar forward of the first locking feature such that movement of the lock bar in the rearward direction to the rearward position will engage the second locking feature with the first locking feature, and subsequent movement of the lock bar in the forward direction will move the lock bar into the forward position to disengage the second locking feature from the first locking feature and permit selective movement of the divider in lateral directions.

4. The apparatus of claim 3 wherein:

the lock bar has a forward end and a longitudinally opposite rearward end; and a handle extends forward from the forward end of the lock bar and is placed adjacent the dispensing location for facilitating selective manual sliding of the lock bar between the forward position and the rearward position.

5. The apparatus of claim 4 wherein:

the first locking feature comprises a series of teeth extending along the retainer plate and projecting in a forward direction; and the second locking feature comprises at least one tooth projecting in a rearward direction for selective engagement with and disengagement from teeth of the first locking feature.

6. The apparatus of claim 5 wherein the predominant portion of the length of the divider is at least about fifty percent of the length of the divider.

7. The apparatus of claim 3 wherein:

the first locking feature comprises a series of teeth extending along the retainer plate and projecting in a forward direction; and the second locking feature comprises at least one tooth projecting in a rearward direction for selective engagement with and disengagement from teeth of the first locking feature.

8. The apparatus of claim 7 wherein the predominant portion of the length of the divider is at least about fifty percent of the length of the divider.

9. The apparatus of claim 1 including:

a second retainer plate for placement along the display shelf adjacent the far end of the divider; and a third locking feature extending in lateral directions along the second retainer plate;

a fourth locking feature carried by the lock bar in position to engage the third locking feature in a locking engagement upon movement of the lock bar into the one of the forward position and the rearward position, thereby further precluding movement of the divider in lateral directions, and in position to disengage the fourth locking feature from the third locking feature upon movement of the lock bar into the other of the forward position and the rearward position, thereby permitting selective movement of the divider in lateral directions.

10. The apparatus of claim 9 wherein:

the retainer plate includes a laterally extending longitudinally forward edge and a laterally extending longitudinally rearward edge;

the first locking feature is juxtaposed with the rearward edge of the retainer plate;

the second locking feature is placed on the lock bar forward of the first locking feature such that movement of the lock bar in the rearward direction to the rearward position will engage the second locking feature with the first locking feature, and subsequent movement of the lock bar in the forward direction will move the lock bar into the forward position to disengage the second locking feature from the first locking feature;

the second retainer plate includes a laterally extending longitudinally forward edge and a laterally extending longitudinally rearward edge;

the third locking feature is juxtaposed with the forward edge of the second retainer plate; and the fourth locking feature is placed on the lock bar forward of the third locking feature such that movement of the lock bar in the rearward direction to the rearward locking position will engage the fourth locking feature with the third locking feature and subsequent movement of the lock bar in the forward direction will move the lock bar into the forward position to disengage the fourth locking feature from the third locking feature.

11. The apparatus of claim 10 wherein:

the first locking feature comprises a series of teeth extending along the retainer plate and projecting in a forward direction; and the second locking feature comprises at least one tooth projecting in a rearward direction for selective engagement with and disengagement from teeth of the first locking feature.

12. The apparatus of claim 10 wherein:

the third locking feature comprises a series of teeth extending along the second retainer plate and projecting in a forward direction; and the fourth locking feature comprises at least one tooth projecting in a rearward direction for selective engagement with and disengagement from teeth of the third locking feature.

13. The apparatus of claim 10 wherein:

the first locking feature comprises a series of teeth extending along the retainer plate and projecting in a forward direction;

the second locking feature comprises at least one tooth projecting in a rearward direction for selective engagement with and disengagement from teeth of the first locking feature;

the third locking feature comprises a series of teeth extending along the second retainer plate and projecting in a forward direction; and the fourth locking feature comprises at least one tooth projecting in a rearward direction for selective engagement with and disengagement from teeth of the third locking feature.

14. The apparatus of claim 13 wherein the predominant portion of the length of the divider is about fifty percent of the length of the divider.

15. The apparatus of claim 13 wherein:

the lock bar has a forward end and a longitudinally opposite rearward end; and a handle extends forward from the forward end of the lock bar and is placed adjacent the dispensing location for facilitating selective manual sliding of the lock bar between the forward position and the rearward position.

16. The apparatus of claim 15 wherein the predominant portion of the length of the divider is at least about fifty percent of the length of the divider.

17. A method for displaying and dispensing merchandise at a point-of-purchase adjacent a display shelf extending in lateral directions, the merchandise being in the form of packages arranged serially along a path of travel extending in longitudinal directions toward a forward dispensing location placed at the point-of-purchase, the method comprising:

extending at least one divider along the longitudinal direction, adjacent the path of travel in juxtaposition with the serially arranged packages, the divider having a basal platform and a length extending between a near end for placement adjacent the forward dispensing location, and a far end spaced longitudinally away from the near end;

securing at least the near end of the divider at a selected lateral location along the display shelf, with the divider extending along the longitudinal direction and the near end affixed against inadvertent movement in a lateral direction, as well as against inadvertent movement in a longitudinal direction, the step of securing including affixing a retainer plate to the display shelf with the retainer plate extending along the lateral directions adjacent the point-of-purchase;

extending a first locking feature in lateral directions along the retainer plate;

coupling an elongate lock bar with the divider for unbiased sliding movement along the divider in longitudinal directions including a forward direction toward the dispensing location, to a forward position, and a rearward direction away from the dispensing location, to a rearward position, the lock bar having a longitudinal length extending in longitudinal directions beneath the basal platform of the divider, along a predominant portion of the length of the divider, with the lock bar extending along the predominant portion of the length of the divider, adjacent a predominant portion of the path of travel, to resist lateral movement of divider relative to the lock bar; and placing a second locking feature on the lock bar in position to engage the first locking feature in a locking engagement upon movement of the lock bar into one of the forward position and the rearward position, thereby precluding movement of the divider in lateral directions, and in position to disengage the second locking feature from the first locking feature upon movement of the lock bar into the other of the forward position and the rearward position, thereby permitting selective movement of the divider in lateral directions.

18. The method of claim 17 wherein the predominant portion of the length of the divider is at least about fifty percent of the length of the divider.

19. The method of claim 17 including:

providing the retainer plate with a laterally extending longitudinally forward edge and a laterally extending longitudinally rearward edge;

juxtaposing the first locking feature with the rearward edge; and placing the second locking feature on the lock bar forward of the first locking feature such that movement of the lock bar in the rearward direction to the rearward position will engage the second locking feature with the first locking feature, and subsequent movement of the lock bar in the forward direction will move the lock bar into the forward position to disengage the second locking feature from the first locking feature and permit selective movement of the divider in lateral directions.

20. The method of claim 17 including:

providing the retainer plate with a laterally extending longitudinally forward edge and a laterally extending longitudinally rearward edge;

juxtaposing the first locking feature with the rearward edge; and placing the second locking feature on the lock bar forward of the first locking feature such that movement of the lock bar in the rearward direction to the rearward position will engage the second locking feature with the first locking feature, and subsequent movement of the lock bar in the forward direction will move the lock bar into the forward position to disengage the second locking feature from the first locking feature and permit selective movement of the divider in lateral directions.

21. The method of claim 20 including:

providing the first locking feature in the form of a series of teeth extending along the retainer plate and projecting in a forward direction; and providing the second locking feature in the form of at least one tooth projecting in a rearward direction for selective engagement with and disengagement from teeth of the first locking feature.

22. The method of claim 17 including:

placing a second retainer plate along the display shelf adjacent the far end of the divider;

extending a third locking feature in lateral directions along the second retainer plate; and placing a fourth locking feature on the lock bar in position to engage the third locking feature in a locking engagement upon movement of the lock bar into the one of the forward position and the rearward position, thereby further precluding movement of the divider in lateral directions, and in position to disengage the fourth locking feature from the third locking feature upon movement of the lock bar into the other of the forward position and the rearward position, thereby permitting selective movement of the divider in lateral directions.

23. The method of claim 22 including affixing the second retainer plate to the display shelf.

24. The method of claim 22 including:

providing the retainer plate with a laterally extending longitudinally forward edge and a laterally extending longitudinally rearward edge;

juxtaposing the first locking feature with the rearward edge of the retainer plate;

placing the second locking feature on the lock bar forward of the first locking feature such that movement of the lock bar in the rearward direction to the rearward position will engage the second locking feature with the first locking feature, and subsequent movement of the lock bar in the forward direction will move the lock bar into the forward position to disengage the second locking feature from the first locking feature;

providing the second retainer plate with a laterally extending longitudinally forward edge and a laterally extending longitudinally rearward edge;

juxtaposing the third locking feature with the forward edge of the second retainer plate; and placing the fourth locking feature on the lock bar forward of the third locking feature such that movement of the lock bar in the rearward direction to the rearward locking position will engage the fourth locking feature with the third locking feature and subsequent movement of the lock bar in the forward direction will move the lock bar into the forward position to disengage the fourth locking feature from the third locking feature.

25. The method of claim 24 including:

providing the first locking feature in the form of a series of teeth extending along the retainer plate and projecting in a forward direction; and providing the second locking feature in the form of at least one tooth projecting in a rearward direction for selective engagement with and disengagement from teeth of the first locking feature.

26. The method of claim 24 including:

providing the third locking feature in the form of a series of teeth extending along the second retainer plate and projecting in a forward direction; and providing the fourth locking feature in the form of at least one tooth projecting in a rearward direction for selective engagement with and disengagement from teeth of the third locking feature.

27. The method of claim 24 including:

providing the first locking feature in the form of a series of teeth extending along the retainer plate and projecting in a forward direction;

providing the second locking feature in the form of at least one tooth projecting in a rearward direction for selective engagement with and disengagement from teeth of the first locking feature;

providing the third locking feature in the form of a series of teeth extending along the second retainer plate and projecting in a forward direction; and providing the fourth locking feature in the form of at least one tooth projecting in a rearward direction for selective engagement with and disengagement from teeth of the third locking feature.

28. The method of claim 27 wherein the predominant portion of the length of the divider is at least about fifty percent of the length of the divider.

* * * * *